US006550549B2

(12) United States Patent
Myrick

(10) Patent No.: US 6,550,549 B2
(45) Date of Patent: Apr. 22, 2003

(54) CORE BREAK-OFF MECHANISM

(75) Inventor: Thomas M. Myrick, Warren, NJ (US)

(73) Assignee: Honeybee Robotics, Ltd., New York, NY (US)

( * ) Notice: Subject to any disclaimer, the term of this patent is extended or adjusted under 35 U.S.C. 154(b) by 0 days.

(21) Appl. No.: 09/938,811

(22) Filed: Dec. 4, 2001

(65) Prior Publication Data

US 2002/0033279 A1 Mar. 21, 2002

Related U.S. Application Data

(60) Provisional application No. 60/228,155, filed on Aug. 25, 2001.

(51) Int. Cl.[7] ..... E21B 49/02
(52) U.S. Cl. ..... 175/58; 175/252
(58) Field of Search ..... 175/252, 251, 175/249, 404, 58, 20

(56) References Cited

U.S. PATENT DOCUMENTS 2,537,605 A * 1/1951 Sewell ..... 175/205
3,086,602 A * 4/1963 Henderson ..... 175/324
4,694,916 A * 9/1987 Ford ..... 175/249
5,211,249 A * 5/1993 Richter et al. ..... 175/20

* cited by examiner

*Primary Examiner*—Hoang Dang
(74) *Attorney, Agent, or Firm*—Leighton K. Chong; Ostrager Chong & Flaherty (Hawaii)

(57) ABSTRACT

A mechanism for breaking off and retaining a core sample of a drill drilled into a ground substrate has an outer drill tube and an inner core break-off tube sleeved inside the drill tube. The break-off tube breaks off and retains the core sample by a varying geometric relationship of inner and outer diameters with the drill tube. The inside diameter (ID) of the drill tube is offset by a given amount with respect to its outer diameter (OD). Similarly, the outside diameter (OD) of the break-off tube is offset by the same amount with respect to its inner diameter (ID). When the break-off tube and drill tube are in one rotational alignment, the two offsets cancel each other such that the drill can operate the two tubes together in alignment with the drill axis. When the tubes are rotated 180 degrees to another positional alignment, the two offsets add together causing the core sample in the break-off tube to be displaced from the drill axis and applying shear forces to break off the core sample.

6 Claims, 4 Drawing Sheets

Core Drilling Configuration

Break-off Configuration
(Break-off Tube rotated 180 degrees)

Core Drilling Configuration

Break-off Configuration
(Break-off Tube rotated 180 degrees)

Core Ejection

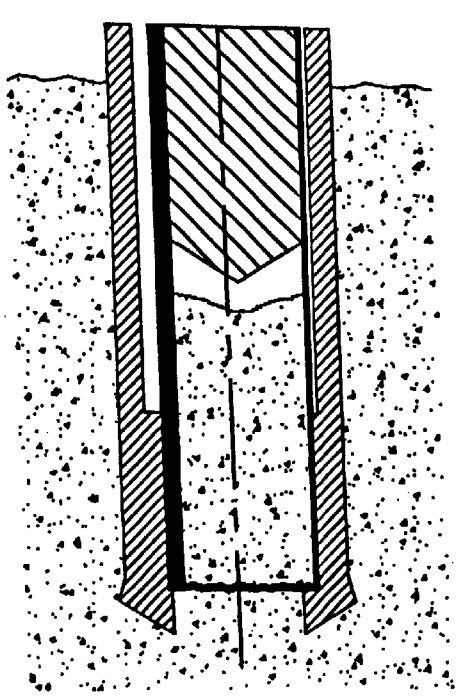
FIGURE 6
FIGURE 7
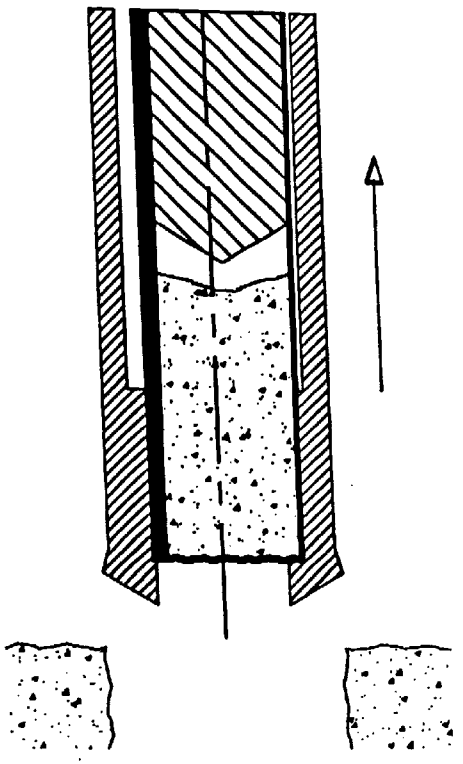
FIGURE 8

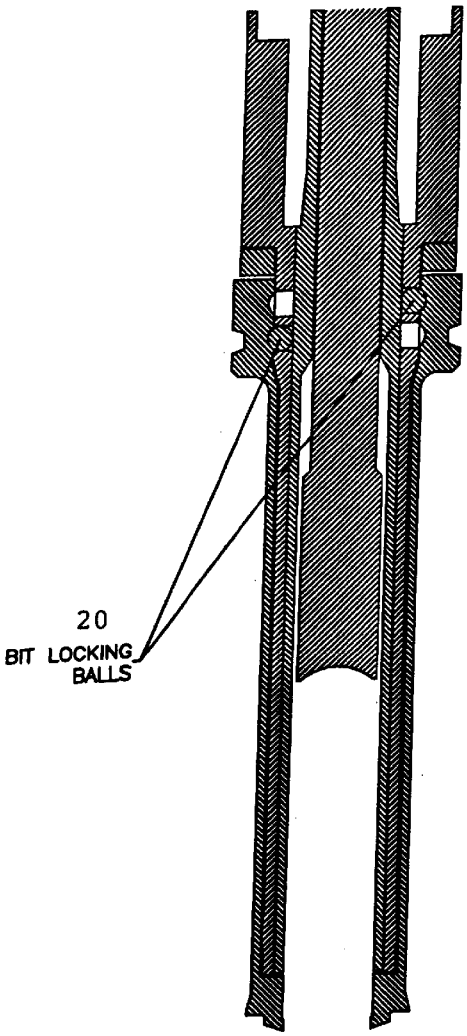
FIGURE 9A
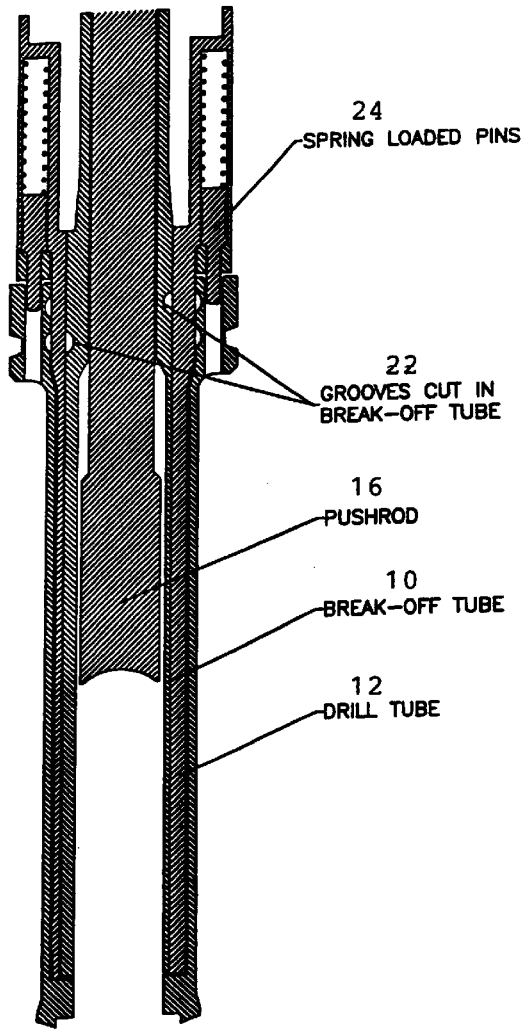
FIGURE 9B
FIGURE 9C
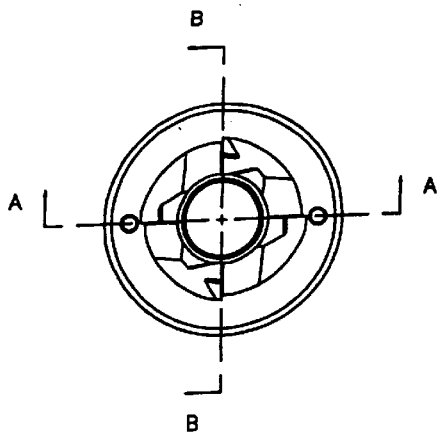

CORE BREAK-OFF MECHANISM

This U.S. patent application claims the priority filing date of U.S. Provisional Application No. 60/228,155 of filed on Aug. 25, 2001, by the same inventor, having the same title.

The subject matter of this U.S. patent application was developed under contract with the National Aeronautics and Space Administration NASA), Contract No. NAS8-40703. The U.S. Government has certain rights in the invention.

TECHNICAL FIELD

This invention generally relates to a mechanism for taking a core drilling sample. In particular, the invention is directed to an improved method of taking core samples or unconsolidated samples from base rock or regolith at any depth using simple elements in a controlled, reliable fashion that does not subject the drill to external loads or movements and does require a stable or hard topographical surrounding to react loads, and more particularly, to a mechanism for breaking off the core sample once it has been drilled.

BACKGROUND OF INVENTION

Prior art core sample methods consist of either drilling completely through the base rock in order to obtain a core sample or drilling to a desired depth and rocking the drill shaft back and forth until the core cracks away from the base rock. It is often impractical to drill completely through the rock to be sampled. The depth of the base rock may not be known or if it is known, it may be far deeper than the desired sampling depth. When obtaining a core sample by drilling to the desired depth and rocking the drill shaft back and forth, several problems arise. The cutting annulus must be great enough to provide sufficient movement of the drill shaft as it is rocked back and forth. If the drill depth is several times greater than the drill diameter, the cutting annulus must be further increased so as to provide the same rocking angle. Soon it becomes impractical to use this method of core extraction at any depth greater than several drill diameters. Drill shaft flexing will also detract from the available rocking angle. Even if these problems were surmountable, the relatively large external loads applied to the drill shaft must react to ground, which can be difficult in sandy or soft surroundings. Additionally, these sampling techniques cannot collect unconsolidated material, as it would simply fall out of the collection tube.

SUMMARY OF INVENTION

In accordance with the present invention, a core break-off mechanism comprises: an inner, core break-off tube extending along a tube axis which is sleeved within and angularly rotatable relative to an outer drill tube, wherein the core break-off tube has a tubular wall of varying thickness such that its inside diameter (C-ID) is offset with respect to its outside diameter (C-OD) by a predetermined amount in a radial direction transverse to the tube axis, and the drill tube has a tubular wall of varying thickness such that its inside diameter (D-ID) is offset with respect to its outside diameter (D-OD) by the same pre-determined amount in a radial direction, and wherein the drill tube has a drill end and a stepped indented shoulder on one lateral side of the tube axis proximate said drill end by which an end of the core break-off tube is retained within the drill tube, whereby when the break-off tube and the drill tube are held in one relative rotational alignment, the two offsets cancel each other such that the D-OD of the drill tube and the C-ID of the break-off tube are centered together on the tube axis and are in positional alignment for drilling a core from base rock to a desired depth, and when the break-off tube is rotated 180 degrees with respect to the drill tube, the offsets add together, causing the rock core within the inner tube to become radially displaced by a distance equal to the sum of the two offsets so as to generate sufficient force to break off the rock core from the base rock.

The invention the method of core break-off using offset tubes. It also includes other features to improve the operation of the drill assembly. Through shape modification, the tubes can be used to fully enclose samples, thus ensuring capture of rock or unconsolidated samples. A pushrod can be used for core extraction, as well as aid in drill stability, and provide an extension to the core drill bit. A combination of bit locking balls and grooves provide automated drill bit change-out capability. The drill assembly provides the ability to capture rock or unconsolidated samples without imparting reaction loads to the local terrain.

Other objects, features, and advantages of the present invention will be explained in the following detailed description of the invention having reference to the appended drawings.

BRIEF DESCRIPTION OF DRAWINGS

FIGS. 9A and 9B are sectional views taken along view lines A—A and B—B in FIG. 9C, respectively, illustrating details of the core drill assembly.

DETAILED DESCRIPTION OF INVENTION

Figure 1:
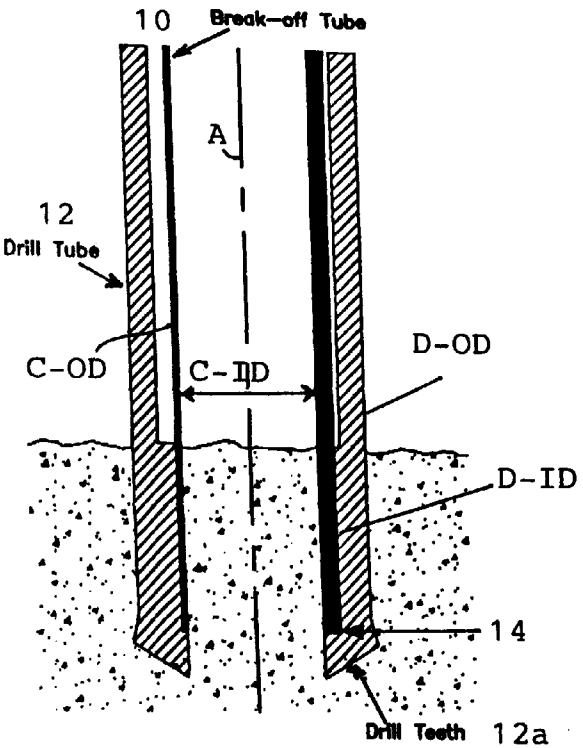
FIG. 1 is a sectional view showing a preferred embodiment of the invention having an outer drill tube and an inner core break-off tube in positional alignment for drilling into base rock.

Referring to FIG. 1, the rock core drill mechanism is made up of two tubes, one sleeved inside and angularly rotatable relative to the other. The outer tube 12 is the drill tube and the inner tube 10 is the break-off tube. The break-off tube shears or breaks off and retains the core via its varying geometric relationship with the drill tube at different rotational positions. The tubes have walls of varying thickness at different places in the radial direction transverse to the tube axis A. The inside diameter of the drill tube (D-ID) is offset from its outer diameter (D-OD) by a predetermined amount relative to the tube axis A. Similarly, the outside diameter of the core break-off tube (C-OD) is offset from its outer diameter (C-OD) by the same predetermined amount. Similarly, the OD of the break-off tube is offset by the same amount with respect to its ID. The drill tube 12 has a drill end 12*a* with drill teeth and a stepped indented shoulder 14 on one lateral side of the tube axis A proximate the drill end 12*a* by which the end of the core break-off tube 10 is retained within the drill tube 12. When the break-off tube 10 and the drill tube 12 are held in proper rotational alignment, the two offsets cancel each other such that the D-OD of the drill tube 12 and the C-ID of the break-off tube 10 are centered on the same axis A. This is the positional alignment for drilling into the base rock to a desired depth.

Figure 2:
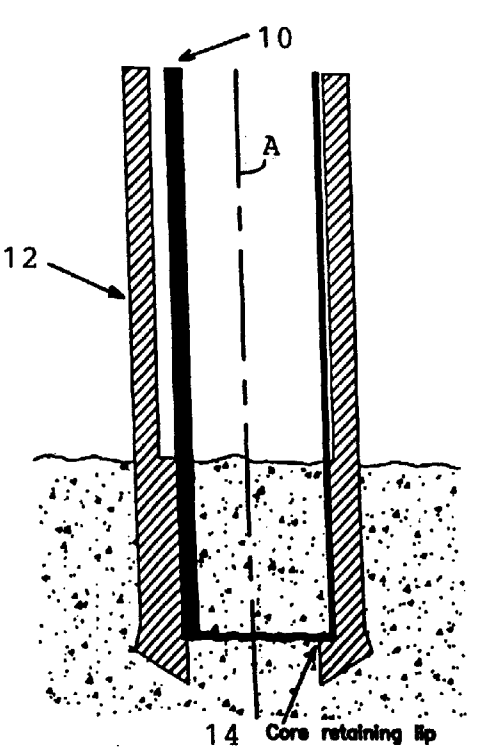
FIG. 2 is a sectional view showing the inner core break-off tube rotated 180 degrees relative to the outer drill tube so as to break off a rock core from the base rock.

In FIG. 2, when the break-off tube 10 is rotated 180 degrees with respect to the drill tube 12, the offsets add together, causing the rock core within the tube assembly to become radially displaced by a distance equal to the sum of the two offsets relative to the tube axis A. This displacement generates sufficient force to cause the rock core to break off from the base rock. The small shelf 14 indented in the side of the drill tube 12 by which the inner tube is retained also acts to positively retain the core sample, thus preventing it from sliding out of the tube assembly. The offset amount may be selected from a few to several millimeters. The shelf 14 has a width approximately equal to the offset amount.

Figure 3:
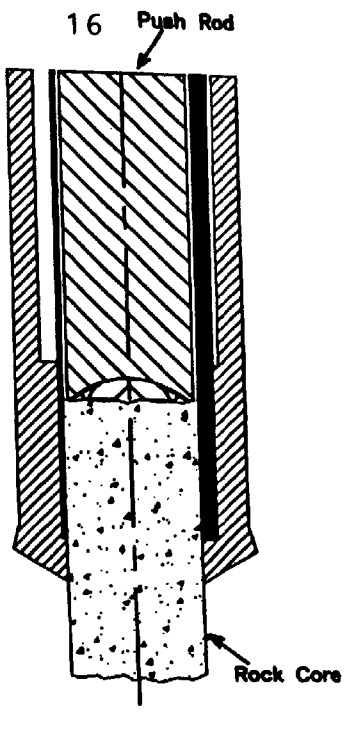
FIG. 3 shows an alternate embodiment having a push rod within the core break-off tube for ejecting the core from the inner tube.

In FIG. 3, an alternate design includes a pushrod 16 that resides within the break-off tube 10 and is used to positively eject the core from the tube assembly. This pushrod 16 can also be used to stabilize the drill end 12*a* when entering a rock so as to prevent wandering or "tornadoing" of the drill teeth as they engage with the rock surface.

Figure 5:
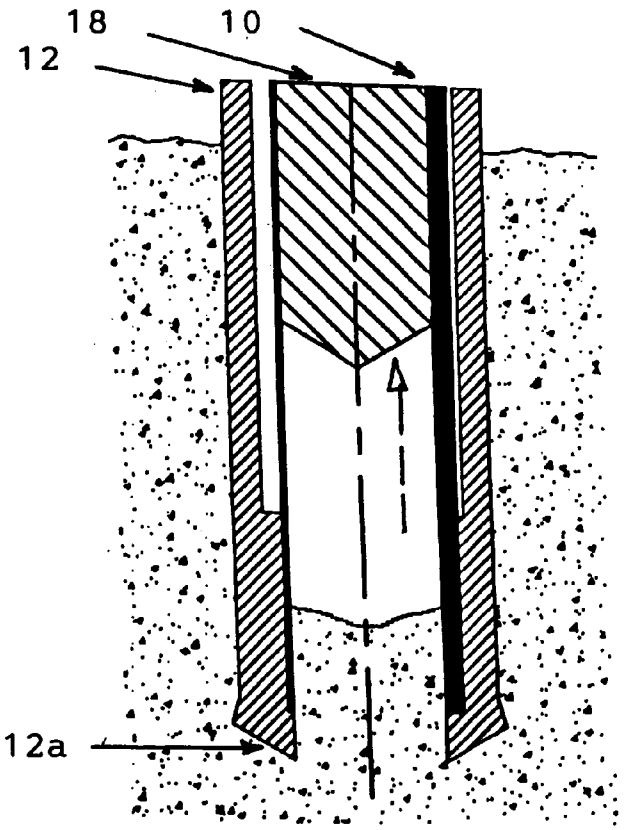
FIGS. 5, 6, 7 and 8 illustrate retraction of the push rod in FIG. 4 to allow the core drill bit to drill a core sample, and rotation of the inner tube to break off the core sample.
Figure 4:
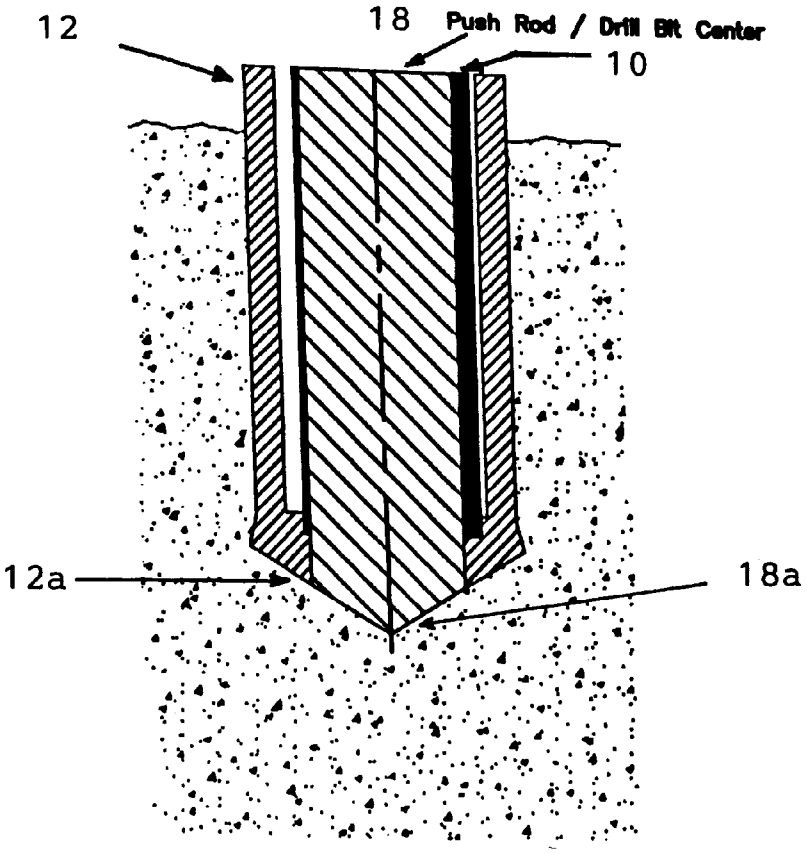
FIG. 4 shows another alternate embodiment in which the push rod has a tip in the shape of a drill bit so that it can act as an extension of the core drill bit.
Figure 1:
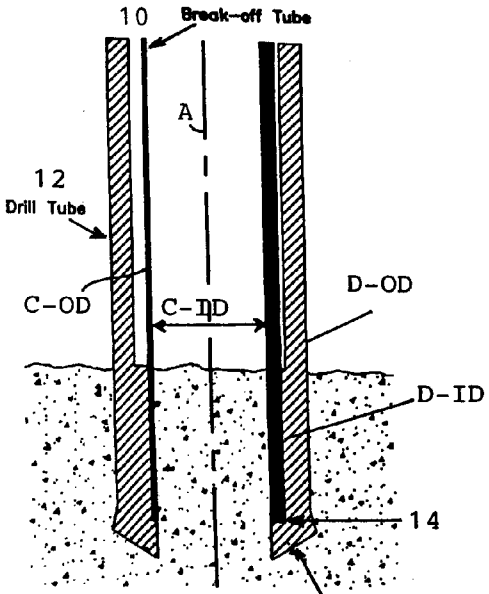
Figure 2:
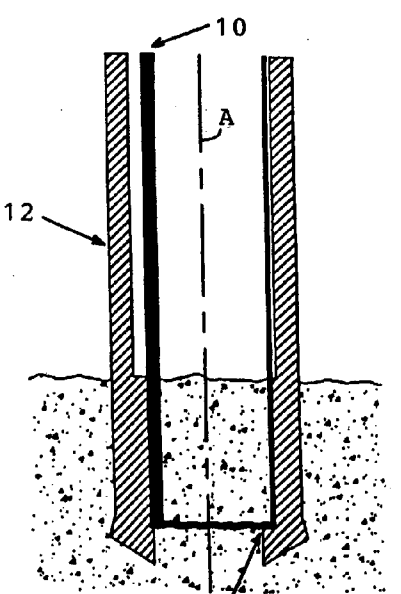
Figure 3:
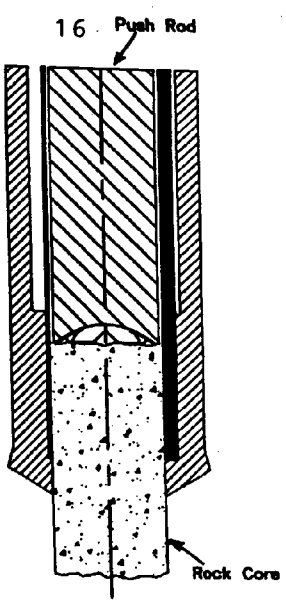
Figure 5:
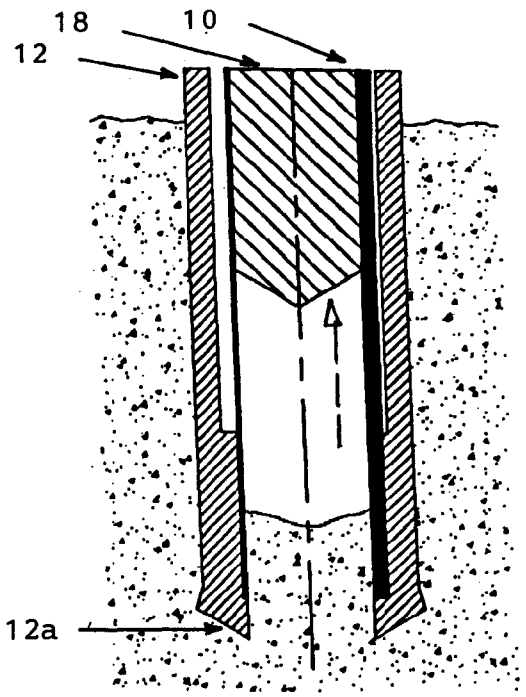
Figure 4:
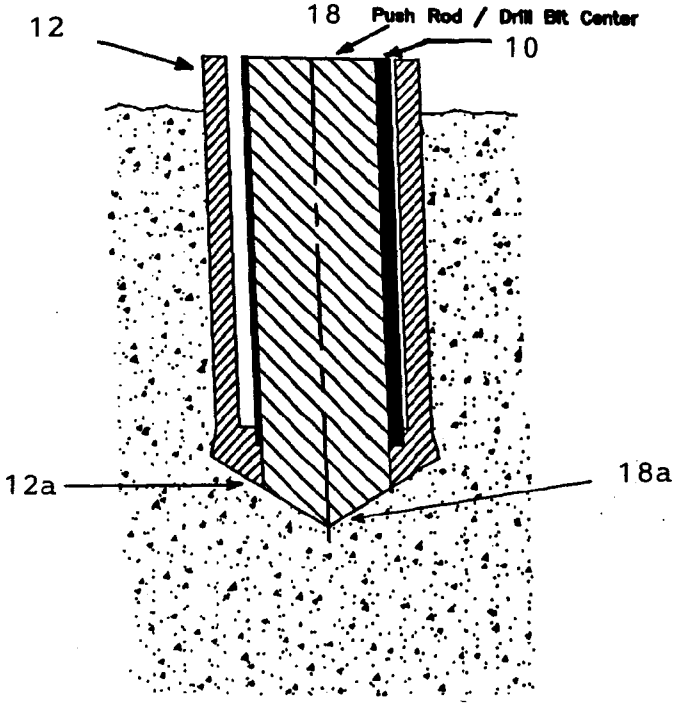
Figure 8:
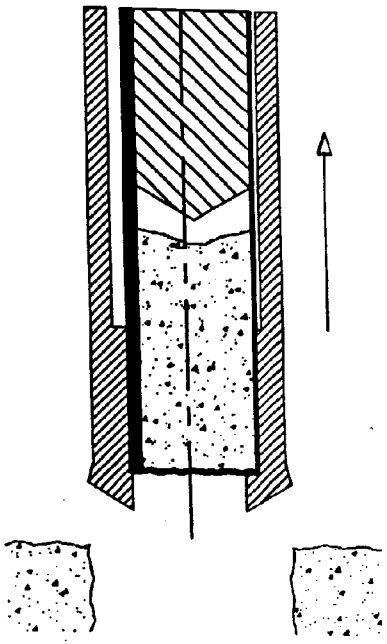
Figure 7:
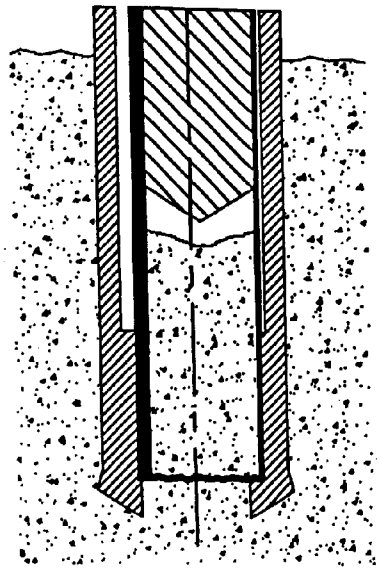
Figure 6:
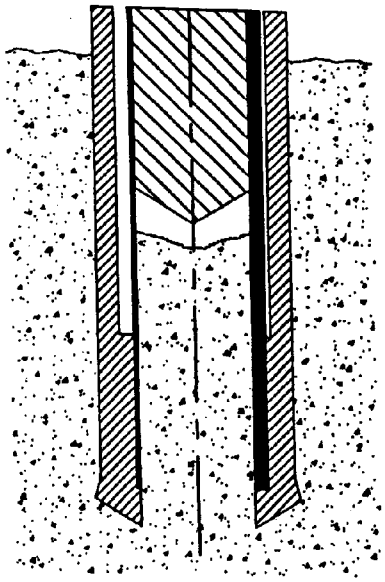

In FIG. 4, an alternative approach of the pushrod design is to shape the tip of the pushrod 18 in the form of a drill bit 18*a*. With this design, the pushrod 18 can be extended to a point where the pushrod bit acts as a natural extension of the core drill bit 12*a* so that the two drill bits look and act like a single drill bit. This will allow traditional drilling to any desired depth. In FIG. 5, the pushrod 18 is then retracted some distance, and the core drill teeth 12*a* is then used to drill a core sample. The core is then broken off by rotating the inner tube and retaining the core sample in the same manner as described above (see FIGS. 6–8).

FIGS. 9A–9C illustrate further details of the core drill assembly. With the inclusion of the pushrod and the rotation capability of the break-off tube, a feature is added to the design that will allow the drill teeth to be removed from the drill tube, and fixed to a separate tube (drill bit) that can be removed from the drill assembly and replaced with a new or different bit as necessary. This can be viewed as a quick-change function. Because the break-off tube needs to rotate between 0 and 180 degrees to cause the core to break off of the base rock, there is an additional 180 degrees of rotation available in the break-off tube to support another task. With the addition of small bit locking balls 20 set into the drill tube that protrude outward but are contained from falling out yet allowed to move inward, these balls 20 can engage with grooves cut into the inside of the drill bit, thus holding the drill bit in place. Grooved areas 22 are cut into the break-off tube such that when the break-off tube is rotated to the 225 degree position, the small balls 20 will fall into these grooved areas 22, thus allowing the bit to be removed from the drill tube. As the break-off tube rotates in the 0 to 180 degree position, the balls are kept from falling inward by the surfaces of the non-grooved areas of the break-off tube. The balls contain the drill bit axially but do not prevent rotational movement during drilling. This is solved by placing two spring loaded pins 24 within the drill tube that engage with holes in the top of the drill bit, thus acting as shear pins that cause the drill bit to rotate with the drill tube during coring operations. This method of bit change-out is but one method that can be used in conjunction with the drill tube, break-off tube and push rod and is not limited to the aforementioned method of attachment. Other methods may include a spline mating of the drill bit to the drill tube and/or a bayonet type of locking feature.

This invention has advantages over prior art in that until now, the only way to retain a rock core sample was to drill completely through the rock which is almost always impractical or to drill to a desired depth and then rock the drill tube back and forth until the core breaks from the base rock. Other methods use very high drill rotation torques and/or high pulling forces that must react through the drill mountings and ultimately, to the local terrain. The difficulty in rocking the drill is that positioning is lost and a large annulus of rock must be cut so that the drill tube can be rocked through a reasonable angle. To cut a larger than necessary annulus is time consuming, power inefficient and requires greater down force. Further, when coring to greater depths, the annulus cut must be greater in order to maintain the same rocking angle. Also, the forces needed for this rocking action must react to ground, which can be difficult in uneven or soft terrain. This invention has none of the problems associated with previous art. A core can be extracted from the base rock at any desired depth with no regard for annulus dimensions, no loss of drill positioning and no need for a stable anchoring to the local terrain. Additionally, this invention can collect loose or unconsolidated material and completely enclose this material within the mechanism thereby ensuring the capture of such material. With the inclusion of a pushrod, the sample can be autonomously ejected into a sample container or testing chamber without the need for tube disassembly or the aid of additional devices.

It is understood that many modifications and variations may be devised given the above description of the principles of the invention. It is intended that all such modifications and variations be considered as within the spirit and scope of this invention, as defined in the following claims.

What is claimed is:

1. A core break-off mechanism comprising: an inner, core break-off tube extending along a tube axis which is sleeved within and angularly rotatable relative to an outer drill tube, wherein the core break-off tube has a tubular wall of varying thickness such that its inside diameter (C-ID) is offset with respect to its outside diameter (C-OD) by a pre-determined amount in a radial direction transverse to the tube axis, and the drill tube has a tubular wall of varying thickness such that its inside diameter (D-ID) is offset with respect to its outside diameter (D-OD) by the same pre-determined amount in a radial direction, and wherein the drill tube has a drill end and a stepped indented shoulder on one lateral side of the tube axis proximate said drill end by which an end of the core break-off tube is retained within the drill tube, whereby when the break-off tube and the drill tube are held in one is relative rotational alignment, the two offsets cancel each other such that the D-OD of the drill tube and the C-ID of the break-off tube are centered together on the tube axis and are in positional alignment for drilling a core from base rock to a desired depth, and when the break-off tube is rotated 180 degrees with respect to the drill tube, the offsets add together, causing the rock core within the inner tube to become radially displaced by a distance equal to the sum of the two offsets so as to generate sufficient force to break off the rock core from the base rock.

2. A core break-off mechanism according to claim 1, further including a pushrod arranged to be axially movable within the core break-off tube for ejecting the core sample.

3. A core break-off mechanism according to claim 2, wherein the pushrod is provided with a drill bit on its end such that the pushrod can be advanced to the end of the core break-off tube and function as an extension of a drill bit provided at a drill tube of the drill tube.

4. A core break-off mechanism according to claim 1, further comprising a core drill assembly that provides a drill bit change-out capability for readily changing the drill tube.

5. A core break-off mechanism according to claim 4, wherein the drill bit change-out capability is provided by small bit locking balls set into the drill tube that protrude outward but are contained from falling out yet allowed to move inward by engaging with grooves cut into the inside of the drill tube, thus holding the drill tube in place.

6. A method of drilling into rock and taking a core sample without generating load stresses on the local terrain comprising:

providing an inner, core break-off tube extending along a tube axis which is sleeved within and angularly rotatable relative to an outer drill tube, wherein the core break-off tube has a tubular wall of varying thickness such that its inside diameter is offset with respect to its outside diameter by a pre-determined amount in a radial direction transverse to the tube axis, and the drill tube has a tubular wall of varying thickness such that its inside diameter is offset with respect to its outside diameter by the same pre-determined amount in a radial direction;

drilling into the rock with a drill end of the drill tube and with the break-off tube and the drill tube held in one relative rotational alignment such that the two offsets cancel each other and the drill tube and break-off tube are centered together on the tube axis; and rotating the break-off tube relative to the drill tube by about 180 degrees with respect to the drill tube, so that the offsets add together and cause the rock core within the inner tube to become radially displaced by a distance equal to the sum of the two offsets to generate sufficient force to break off the rock core from the base rock.

* * * * *

UNITED STATES PATENT AND TRADEMARK OFFICE

CERTIFICATE OF CORRECTION

PATENT NO. : 6,550,549 B2 
DATED : April 22, 2003
INVENTOR(S) : Myrick

It is certified that error appears in the above-identified patent and that said Letters Patent is hereby corrected as shown below:

Title page showing Figs. 1 and 2 should be replaced with the attached title page.

Drawings,
Figs. 1-8, should be replaced with the attached Figs 1-8.

Signed and Sealed this

Twenty-sixth Day of August, 2003

JAMES E. ROGAN
*Director of the United States Patent and Trademark Office*

(12) United States Patent
Myrick

(10) Patent No.: US 6,550,549 B2
(45) Date of Patent: Apr. 22, 2003

(54) CORE BREAK-OFF MECHANISM

(75) Inventor: Thomas M. Myrick, Warren, NJ (US)

(73) Assignee: Honeybee Robotics, Ltd., New York, NY (US)

( * ) Notice: Subject to any disclaimer, the term of this patent is extended or adjusted under 35 U.S.C. 154(b) by 0 days.

(21) Appl. No.: 09/938,811

(22) Filed: Dec. 4, 2001

(65) Prior Publication Data

US 2002/0033279 A1 Mar. 21, 2002

Related U.S. Application Data

(60) Provisional application No. 60/228,155, filed on Aug. 25, 2001.

(51) Int. Cl.[7] ..... E21B 49/02

(52) U.S. Cl. ..... 175/58; 175/252

(58) Field of Search ..... 175/252, 251, 175/249, 404, 58, 20

(56) References Cited

U.S. PATENT DOCUMENTS 2,537,605 A * 1/1951 Sewell ..... 175/205
3,086,602 A * 4/1963 Henderson ..... 175/324
4,694,916 A * 9/1987 Ford ..... 175/249
5,211,249 A * 5/1993 Richter et al. ..... 175/20

* cited by examiner

*Primary Examiner*—Hoang Dang
(74) *Attorney, Agent, or Firm*—Leighton K. Chong; Ostrager Chong & Flaherty (Hawaii)

(57) ABSTRACT

A mechanism for breaking off and retaining a core sample of a drill drilled into a ground substrate has an outer drill tube and an inner core break-off tube sleeved inside the drill tube. The break-off tube breaks off and retains the core sample by a varying geometric relationship of inner and outer diameters with the drill tube. The inside diameter (ID) of the drill tube is offset by a given amount with respect to its outer diameter (OD). Similarly, the outside diameter (OD) of the break-off tube is offset by the same amount with respect to its inner diameter (ID). When the break-off tube and drill tube are in one rotational alignment, the two offsets cancel each other such that the drill can operate the two tubes together in alignment with the drill axis. When the tubes are rotated 180 degrees to another positional alignment, the two offsets add together causing the core sample in the break-off tube to be displaced from the drill axis and applying shear forces to break off the core sample.

6 Claims, 4 Drawing Sheets

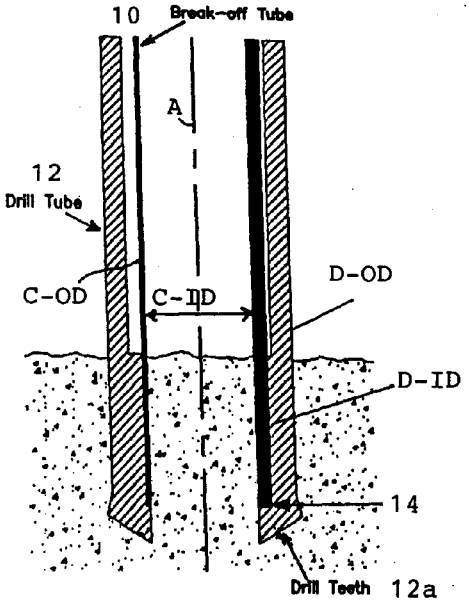

Core Drilling Configuration

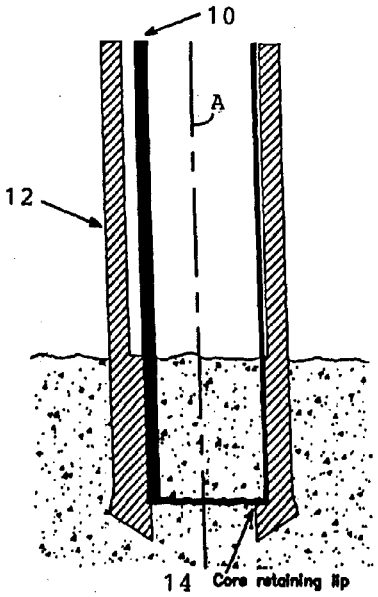

Break-off Configuration
(Break-off Tube rotated 180 degrees)

Core Drilling Configuration

Break-off Configuration
(Break-off Tube rotated 180 degrees)

Core Ejection